United States Patent [19]

Nakamura et al.

[11] Patent Number: 4,614,493

[45] Date of Patent: Sep. 30, 1986

[54] HEAT RADIATION-TYPE OIL BURNER

[75] Inventors: Kazuharu Nakamura; Tooru Yoshino, both of Nagoya, Japan

[73] Assignee: Toyotomi Kogyo Co., Ltd., Aichi, Japan

[21] Appl. No.: 594,175

[22] Filed: Mar. 28, 1984

[30] Foreign Application Priority Data

Mar. 29, 1983 [JP] Japan ..... 58-45386[U]

[51] Int. Cl.[4] ..... F23D 5/02

[52] U.S. Cl. ..... 431/341; 431/342; 126/92 AC; 126/93

[58] Field of Search ..... 126/92 R, 92 AC, 92 C, 126/95, 96; 431/195, 196, 200, 201, 331-342

[56] References Cited

U.S. PATENT DOCUMENTS

| | | | |
|---|---|---|---|
| Re. 11,575 | 11/1896 | Blackford | 431/201 |
| 1,458,774 | 6/1923 | Meyers | 431/201 |
| 2,517,985 | 8/1950 | Davis | 431/201 |
| 2,627,909 | 2/1953 | Moore | 431/336 |
| 4,390,003 | 6/1983 | Nakamura et al. | 126/96 |
| 4,484,886 | 11/1984 | Nakamura et al. | 431/201 |

FOREIGN PATENT DOCUMENTS

| | | | |
|---|---|---|---|
| 145696 | 3/1952 | Australia | 431/201 |
| 1540 | 1/1977 | Japan | 431/333 |
| 112919 | 9/1980 | Japan | 431/201 |
| 108309 | 12/1981 | Japan | 431/201 |

*Primary Examiner*—Margaret A. Focarino

*Attorney, Agent, or Firm*—Pollock, Vande Sande & Priddy

[57] ABSTRACT

An oil burner of the heat radiation type is disclosed which is capable of effectively preventing clouding of the inner surface of a heat-permeable cylinder with moisture, contaminants contained in combustion gas such as soot and tar, and the like during at the ignition and combustion operation.

The oil burner includes a communicating means for establishing the communication between an air supply passage and a space between a heat-permeable cylinder and an outer combustion cylinder, which comprises a top plate for a pot having through-holes formed at the portion thereof above the air supply passage and a top plate for a housing having through-holes formed at the portion below the space, to thereby allow air to be introduced directly from the air supply passage to the space and upward flow along the inner surface of the heat-permeable cylinder.

11 Claims, 1 Drawing Figure

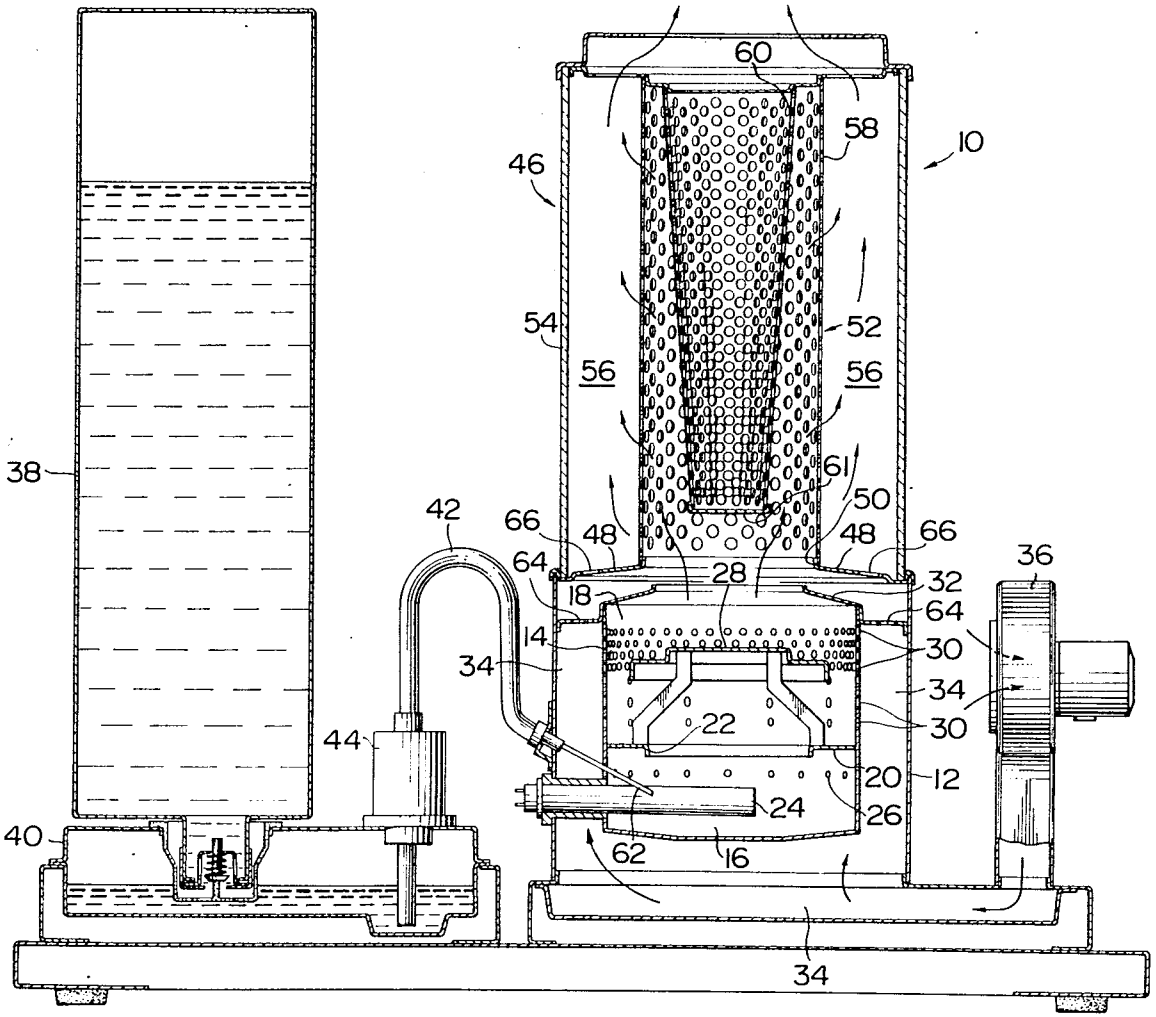
10
12
14
16
18
20
22
24
26
28
30
32
34
36
38
40
42
44
46
48
50
52
54
56
58
60
61
62
64
66

HEAT RADIATION-TYPE OIL BURNER

BACKGROUND OF THE INVENTION

1. Field of the Invention

This invention relates to a heat radiation type oil burner, and more particularly to an oil burner adapted to prevent the inner surface of an outermost heat-permeable cylinder from clouding with water vapor or exhaust gas generated during the ignition operation or combustion operation.

2. Description of the Prior Art

In general, a heat radiation type oil burner includes a multiple combustion cylinder construction which comprises red-heated inner and outer cylindrical members and a heat-permeable cylinder arranged to surround the cylindrical members with a space being defined therebetween. In such structure of the oil burner, when water vapor or exhaust gas containing water vapor remains in the space between the outer cylindrical member and the heat-permeable cylinder, the water vapor is liquidified to form fine waterdrops on the inner surface of the heat-permeable cylinder or form white fume to cause clouding of the inner surface of the heat-permeable cylinder to decrease the efficiency of heat radiation of the oil burner.

Such phenomenon frequently appears at the ignition operation during which the heat-permeable cylinder is not yet heated to a high temperature. Such clouding of the heat-permeable cylinder with waterdrops causes a contaminant such as soot, tar or the like contained in the exhaust gas to be absorbed by the waterdrops to stain the inner surface of the heat-permeable cylinder. This results in the efficiency of heat radiation of the oil burner being further decreased, as well as the appearance of the oil burner being injured. Also, it should be noted that such staining cannot be readily removed because it occurs on the inner surface of the heat-permeable cylinder.

Accordingly, it would be highly desirable to develop an oil burner of the heat radiation type which is capable of preventing clouding of the inner surface of a heat-permeable cylinder with moisture and exhaust gas.

SUMMARY OF THE INVENTION

The present invention has been made in view of the foregoing disadvantage of the prior art while taking notice of the fact that the flow of fresh air along the inner surface of a heat-permeable cylinder efficiently prevents the above-mentioned clouding of the inner surface of the cylinder.

In accordance with the present invention, there is provided an oil burner of the heat radiation type comprising a housing; a burner body received in said housing; a combustion cylinder construction arranged on said housing in a manner to be communicated with said burner body, said combustion cylinder construction comprising a red-heated combustion cylinder means and a heat-permeable cylinder arranged to surround said cylinder means with a space being defined between said cylinder means and said heat-permeable cylinder; an air supply passage defined between said housing and said burner body to supply air therethrough to said burner body; and a mechanism for preventing clouding of the inner surface of said heat-permeable cylinder.

In a preferred embodiment of the present invention, said mechanism for preventing clouding of the inner surface of said heat-permeable cylinder comprises a communicating means for establishing the communication between said space of said combustion cylinder construction and said air supply passage to supply a part of air in said air supply passage to said space.

In a preferred embodiment of the present invention, said communicating means comprises a first annular plate having an opening formed at the central portion thereof, said first annular plate outward extending from the top of said burner body to said housing and having at least one through-hole formed at the portion positioned above said air supply passage; and a second annular plate having an opening formed at the central portion thereof and adapted to support said combustion cylinder construction thereon, said second annular plate inward extending from the top of said housing to said red-heated cylinder means and having at least one through-hole formed at the portion thereof positioned below said space of said combustion cylinder construction; whereby said air supply passage is communicated via said through-holes of said first and second annular plates directly with said space.

In a preferred embodiment of the present invention, said first annular plate is a top plate for said burner body and said second annular plate is a top plate for said housing.

In a preferred embodiment of the present invention, said first annular plate is formed with a plurality of said through-holes which are circularly arranged in at least one row, and said second annular plate is also formed with a plurality of said through-holes which are arranged in at least one row.

Furthermore, in the preferred embodiment of the present invention, said through-holes of said second annular plate are arranged in proximity to said heat-permeable cylinder.

Accordingly, it is an object of the present invention to provide an oil burner of the heat radiation type which is capable of effectively preventing clouding of the inner surface of a heat-permeable cylinder.

It is another object of the present invention to provide an oil burner of the heat radiation type which is capable of accomplishing the prevention of clouding of the inner surface of a heat-permeable cylinder with an extremely simple structure.

It is a further object of the present invention to provide an oil burner of the heat radiation type which is capable of keeping the inner surface of a heat-permeable cylinder clean to ensure heat radiation of the oil burner with good efficiency and prevent the appearance of the oil burner from being injured.

BRIEF DESCRIPTION OF THE DRAWINGS

Other objects and many of the attendant advantages of the present invention will be readily appreciated as the same becomes better understood by reference to the following detailed description when considered with the accompanying drawing, wherein:

the single FIGURE is a vertical sectional view showing an embodiment of an oil burner of the heat radiation type according to the present invention.

DETAILED DESCRIPTION OF THE PREFERRED EMBODIMENTS

Now, an oil burner of the heat radiation type according to the present invention will be described with reference to the accompanying drawing.

The single FIGURE illustrates an embodiment of an oil burner of the heat radiation type according to the present invention wherein the oil burner is generally indicated by reference numeral 10. The oil burner illustrated is formed into a pot-type oil burner, however, it should be noted that the present invention is not limited to such a pot-type oil burner.

The heat radiation type oil burner 10 of the illustrated embodiment includes a housing 12 and a burner body 14 received in the housing 12. In the embodiment, the burner body 14 comprises a pot. The pot 14 is adapted to carry out the vaporization and ignition of fuel oil such as kerosene supplied thereto and the combustion of vaporized fuel oil therein. The pot 14 has a lower chamber 16 and an upper chamber 18 formed therein which are separated from each other by a horizontal partition 20 having an opening 22 formed at the central portion thereof, through which the chambers 16 and 18 are communicated with each other. The lower chamber 16 has an electric heater 24 arranged therein, which acts to heat fuel oil supplied to the pot 14 to vaporize it and ignite vaporized fuel oil using air mainly supplied from through-holes 26 formed at the side wall of the lower chamber 16. In the embodiment, the heater 24 is positioned in proximity to the bottom surface of the lower chamber 16 to heat it to a high temperature, to thereby effectively vaporize fuel oil rained thereon.

The upper chamber 18 has a plate means 28 arranged therein above the opening 22 and formed into an inverted-dish shape to facilitate the mixing of vaporized fuel oil with air supplied thereto via a plurality of through-holes 30 formed at the side wall thereof and spread flame of fuel oil ignited in the lower chamber 16. Thus, it will be readily noted that the upper chamber 18 serves to form combustible gas and burn the so-formed combustible gas therein.

In the embodiment, the burner body or pot 14 is suspended in the housing 12 by means of a top plate 32 of the pot extending from the pot 14 to the housing 12, so that a space 34 may be defined between the housing and the pot. The top plate 32 is annularly formed. The space 34 serves as an air supply passage for supplying air from an air fan 36 provided at the outside of the housing 12 therethrough to the pot 14. The air supply passage 34 is communicated via the through-holes 26 and 30 of the pot 14 with the pot.

The oil burner 10 further includes an oil supply means for supplying fuel oil to the pot 14. The oil supply means comprises an oil tank 38, an oil reservoir 40 and an oil supply pipe 42. The oil reservoir 40 is adapted to permit the tank 38 to be supported thereon in an inverted manner and keep fuel oil to be supplied from the reservoir 40 to the pot 14 at a constant level. Fuel oil may be forcedly supplied by means of an electromagnetic pump 44 arranged between the oil supply pipe 42 and the oil reservoir 40.

Furthermore, the heat radiation type oil burner 10 includes a multiple combustion cylinder construction 46 supported on the housing 12. In the embodiment, the combustion cylinder construction 46 is supported on a top plate 48 of the housing 12, at the central portion of which an opening 50 is formed to communicate the pot 14 therethrough with the combustion cylinder construction 46. The combustion cylinder construction 46 is adapted to emit heat rays therefrom. More particularly, the construction includes a red-heated cylinder means 52 and a heat-permeable cylinder 54 arranged to surround the red-heated cylinder means 52 with an annular space 56 being defined therebetween. In the embodiment illustrated, the red-heated cylinder means 52 consists of an outer perforated cylinder 58 and an inner perforated cylinder 60 having a bottom 61. In the combustion cylinder construction, heat due to combustion in the pot 14 renders the cylinders 58 and 60 red-heated, to thereby allow the cylinders 58 and 60 to emit heat rays therefrom.

In the embodiment illustrated in the FIGURE, the oil supply pipe 42 is formed with a nozzle pipe 62 at the distal end thereof, which extends through the side wall of the pot 14 thereinto and has an inner diameter substantially smaller than the oil supply pipe 42.

Still further, the oil burner of the heat radiation type includes a mechanism for preventing clouding of the inner surface of the heat-permeable cylinder 54. The mechanism may comprise a communication means for establishing the communication between the space 56 between the heat-permeable cylinder 54 and the red-heated cylinder means 52 and the air supply passage 34 to supply a part of air in the air supply passage therethrough to the space 56. More particularly, in the illustrated embodiment, the top plate 32 of the pot 14 is provided with at least one through-hole or slit 64 and the top plate 48 of the housing 12 is also provided with at least one through-hole or slit 66, so that the air supply passage 34 may be communicated via the through-holes 64 and 66 with the space 56. It is preferable to annularly arrange a plurality of the through-holes 66 in a row or rows to allow air to be more uniformly distributed in the circumferential direction of the inner surface of the heat-permeable cylinder 54. For the same purpose, the top plate 32 is preferably provided with a plurality of the through-holes 64 which are annularly arranged in a row or rows. Also, the through-holes 66 are preferably formed adjacent to the heat-permeable cylinder 54 to permit air to flow in proximity to the inner surface of the cylinder 54, to thereby more effectively prevent the access of combustion or exhaust gas to the heat-permeable cylinder.

Such construction allows air introduced from the air supply passage 34 via the through-holes 64 and 66 into the space 56 to upwardly uniformly flow along the substantially entire inner surface of the heat-permeable cylinder 54, to thereby carry out prevention of the clouding.

The manner of operation of the heat radiation type oil burner will be described hereinafter with reference to the FIGURE.

First, electrical current is supplied to the heater 24 to heat the pot 14 to a predetermined temperature, and air is supplied through the air supply passage 34 and the through-holes 26 and 30 to the pot 14 by means of the air fan 36. Then, fuel oil is fed from the reservoir 40 through the oil supply pipe 42 and the nozzle pipe 62 to the lower chamber 16 by means of the electromagnetic pump 44, and instantly heated and vaporized in the lower chamber 16. The heater 24 also acts to ignite the vaporized fuel oil to allow a part of the vaporized fuel oil to be burned in the lower chamber 16 using air supplied from the air supply passage 34 via the through-holes 26 to the lower chamber 16. During the ignition operation, even if soot and/or tar are contained in exhaust gas together with water vapor, these do not substantially adhere to the inner surface of the heat-permeable cylinder 54 in spite of the fact that it is not yet heated to a high temperature; because air is upward flowed from the air supply passage 34 via the through-holes 64 and 66 along the substantially entire inner surface of the cylinder 54.

The vaporized fuel oil is then introduced through the opening 22 of the partition 20 into the upper chamber 18 together with flame formed in the lower chamber 16 and mixed with air supplied from the air supply passage 34 via the through-holes 30 of the upper chamber 18 thereto to form combustible gas, and is substantially burned in the chamber 18. The combustion in the pot 14 allows the cylinders 58 and 60 to be red-heated to emit heat rays therefrom, which are discharged through the heat-permeable cylinder 54 to the outside. During the combustion operation, even when combustion gas is generated containing soot and/or tar together with water vapor depending upon the operating conditions or the like, these do not adhere to the inner surface of the cylinder 54; since the cylinder 54 is covered at the substantially entire inner surface thereof with air upward flowing along the surface.

As can be seen from the foregoing, the oil burner of the heat radiation type according to the present invention is capable of effectively preventing clouding of the inner surface of the heat-permeable cylinder with moisture, soot and tar contained in combustion gas, and the like, with a simple structure.

It will be thus seen that the objects set forth above, among those made apparent from the preceding description, are efficiently attained and, since certain changes may be made in the above construction set forth without departing from the spirit and scope of the invention, it is intended that all matter contained in the above description and shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A pot-type oil burner of the heat radiation type comprising:

a housing;

a pot received in said housing;

a combustion cylinder construction arranged on said housing so as to be in communication with said pot, said combustion cylinder construction comprising a red-heated combustion cylinder means and a heat-permeable cylinder arranged to surround said cylinder means with a space being defined between said means and an inner surface of said heat-permeable cylinder;

an air supply passage defined between said housing add said pot so as to supply air therethrough to said pot; and clouding prevention means for providing a flow of air along the inner surface of said heat-permeable cylinder so as to prevent clouding of said inner surface by moisture, exhaust gas or the like, said clouding prevention means comprising a communicating means for establishing communication between said space of said combustion cylinder construction and said air supply passage so as to supply a part of the air in said air supply passage to said space.

2. An oil burner of the heat radiation type as defined in claim 1, wherein said communicating means comprises:

a first annular plate having an opening formed at the central portion thereof, said first annular plate extending outward from the top of said pet to said housing and having at least one through-hole formed at a portion thereof positioned above said air supply passage; and a second annular plate having an opening formed at the central portion thereof and adapted to support said combustion cylinder thereon, said second annular plate extending inward from the top of said housing to said red-heated cylinder means and having at least one through-hole formed at a portion thereof positioned below said space of said combustion cylinder construction;

whereby said air supply passage is communicated via said through-holes of said first and second annular plates directly with said space.

3. An oil burner of the heat radiation type as defined in claim 1, wherein said clouding prevention means includes fan means for providing a forced flow of air along the inner surface of said heat-permeable cylinder.

4. An oil burner of the heat radiation type as defined in claim 1, wherein said clouding prevention means includes an annular plate extending inwardly from said housing to said red-heated cylinder means, said annular plate having an opening formed at a central portion thereof and at least one opening formed at a portion thereof positioned below said red-heated cylinder means and adjacent to the lower edge of said heat-permeable cylinder so as to cause said flow of air to flow upwardly along substantially the entire inner surface of said heat-permeable cylinder.

5. An oil burner of the heat radiation type as defined in claim 1, which further includes means for introducing air into said pot from said air supply passage so as to ignite and burn fuel oil within said pot; and wherein said clouding prevention means includes a first annular plate having an opening formed at a central portion thereof and at least one opening formed in an annular portion thereof, and a second annular plate having an opening formed at a central portion thereof and at least one opening formed at an annular portion thereof, said first plate providing a top plate for said pot and said second plate providing a top plate for said housing and said first plate and said second plate defining therebetween a through passage for introducing air into said space from said air supply passage beyond said means for introducing air into said pot.

6. An oil burner of the heat radiation type comprising:

a housing;

a burner body received in said housing;

a combustion cylinder construction arranged on said housing so as to be in communication with said burner body, said combustion cylinder construction comprising a red-heated combustion cylinder means and a heat-permeable cylinder arranged to surround said cylinder means with a space being defined between said cylinder means and an inner surface of said heat-permeable cylinder;

an air supply passage defined between said housing and said burner body so as to supply air therethrough to said burner body; and, air flow means for providing a flow of air along the inner surface of said heat-permeable cylinder so as to prevent clouding of said inner surface by moisture, exhaust gas or the like;

said air flow means comprising a communicating means for establishing communication between said space of said combustion cylinder construction and said air supply passage so as to supply a part of the air in said air supply passage to said space, a first annular plate having an opening formed at a central portion thereof, said first annular plate extending outward from the top of said burner body to said housing and having at least one through-hole formed at a portion thereof positioned above said air supply passage; and, a second annular plate having an opening formed at the central portion thereof and adapted to support said combustion cylinder thereon, said second annular plate extending inward from the top of said housing to said red-heated cylinder means and having at least one through-hole formed at a portion thereof positioned below said space of said combustion cylinder construction;

whereby said air supply passage is communicated via said through-holes of said first and second annular plates directly with said space.

7. An oil burner of the heat radiation type as defined in claim 6, wherein said first annular plate is a top plate for said pot and said second annular plate is a top plate for said housing.

8. An oil burner of the heat radiation type as defined in claim 6, wherein said first annular plate is formed with a plurality of said through-holes which are annularly arranged in a row or rows, and said second annular plate is also formed with a plurality of said through-holes which are annularly arranged in a row or rows.

9. An oil burner of the heat radiation type as defined in claim 7, wherein said through-holes of said second annular plate are arranged in proximity to said heat-permeable cylinder.

10. An oil burner of the heat radiation type comprising:

a housing;

a pot received in said housing;

a combustion cylinder construction supported on said housing so as to be communicated with said pot, said combustion cylinder construction comprising a red-heated double combustion cylinder having an inner cylindrical member and an outer cylindrical member, and a heat-permeable cylinder arranged to surround said double combustion cylinder with a space being defined between said heat-permeable cylinder and said double combustion cylinder;

an air supply passage defined between said housing and said pot to supply air therethrough to said pot;

an annular top plate for said pot outward extending from the top of said pot to said housing and having a plurality of through-holes formed in at least one row;

an annular top plate for said housing inward extending from the top of said housing to said outer cylindrical member of said combustion cylinder construction and having a plurality of through-holes arranged in at least one row, said annular top plate for said housing supporting said combustion cylinder construction thereon;

whereby a part of the air in said air supply passage is introduced via said through-holes of said top plates directly into said space of said combustion cylinder construction and upward flows along the inner surface of said heat-permeable cylinder.

11. An oil burner of the heat radiation type as defined in claim 10, wherein said through-holes of said annular top plate for said housing are disposed in proximity to said heat-permeable cylinder.

* * * * *